US007222946B2

(12) United States Patent
Machida et al.

(10) Patent No.: US 7,222,946 B2
(45) Date of Patent: May 29, 2007

(54) INK JET HEAD AND DROPLET EJECTION DEVICE HAVING SAME MOUNTED THEREON

(75) Inventors: Osamu Machida, Ibaraki (JP); Kunio Satou, Ibaraki (JP); Kazuo Shimizu, Ibaraki (JP); Yoshinari Suzuki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 189 days.

(21) Appl. No.: 10/824,588

(22) Filed: Apr. 15, 2004

(65) Prior Publication Data

US 2004/0207696 A1 Oct. 21, 2004

(30) Foreign Application Priority Data

Apr. 18, 2003 (JP) ..... P.2003-114106
Feb. 19, 2004 (JP) ..... P.2004-043257

(51) Int. Cl.
*B41J 2/045* (2006.01)

(52) U.S. Cl. ..... 347/70

(58) Field of Classification Search ..... 347/70, 347/68–69, 71–72, 58; 357/100; 29/890.01, 29/25.35

See application file for complete search history.

(56) References Cited

U.S. PATENT DOCUMENTS 6,945,632 B2 * 9/2005 Nakamura et al. ..... 347/58
2002/0174542 A1 * 11/2002 Watanabe et al. ..... 29/890.01
2002/0180843 A1 * 12/2002 Irie et al. ..... 347/70
2003/0067525 A1 * 4/2003 Goto et al. ..... 347/100

FOREIGN PATENT DOCUMENTS

JP 2003-39673 2/2003

* cited by examiner

*Primary Examiner*—K. Feggins
(74) *Attorney, Agent, or Firm*—McGinn IP Law Group PLLC

(57) ABSTRACT

An ink jet head includes: a chamber plate having a plurality of pressuring chambers formed therein for storing an ink; a vibrating plate bonded to the chamber plate; a housing having an ink flow path through which an ink is supplied into the pressuring chambers; an orifice through which an ink is ejected from the pressuring chambers; and a longitudinal vibration mode piezoelectric element for generating pressure under which an ink droplet is ejected through the orifice. A thickness of the vibration plate is from 5 μm to 10 μm.

17 Claims, 4 Drawing Sheets

INK JET HEAD AND DROPLET EJECTION DEVICE HAVING SAME MOUNTED THEREON

BACKGROUND OF THE INVENTION

1. Field of the Invention

The present invention relates to an ink jet head which ejects an ink droplet to perform recording and a droplet ejection device having the ink jet head mounted thereon.

2. Background Art

An ink jet head is normally arranged such that a driving unit such as piezoelectric element and heating resistor is driven to pressurize an ink which has been introduced into a pressurizing chamber through an ink inlet so that the ink is ejected through an orifice. With the recent development of ink jet technique, ink jet head has not only been used in printing on paper but has also reached industrial use as constant amount droplet ejection device, including the production of wiring pattern and color filter for liquid crystal. These uses involve the use of aqueous ink as well as various liquids such as oil-based ink, solvent, strong acid and strong alkali. Therefore, the ink jet head is required to have chemical resistance. In order to meet requirements for drawing of fine pattern, the recent tendency is more ink jet heads to have a higher density for ejection of minute droplet. Thus, a technique of efficiently ejecting droplets from such a small ink chamber has been desired.

In order to eject minute droplets, a thermal ink jet system is advantageous taking into account the configuration. However, this system requires that only an aqueous ink be used as a solution to be ejected and thus cannot be put to the aforementioned industrial uses. On the other hand, a drop-on-demand piezoelectric element type ink jet head which allows deformation of a piezoelectric element to apply external pressure change to an ink chamber from outside the wall thereof so that a droplet is ejected is advantageous in that there are a wide variety of solutions which can be ejected but is disadvantageous in that pressure change can difficultly be given efficiently to the ink chamber, if it is small.

As a method for efficiently deforming the vibration plate of a small ink chamber using a piezoelectric element there has been proposed a method which comprises controlling a vibration system comprising a vibration factor of piezoelectric element and a flow path system connected to each other using a filmy piezoelectric element which undergoes deflection (see, e.g., JP-A-2003-39673).

However, the aforementioned related art technique involves the deflection of the piezoelectric element and thus is disadvantageous in that when the area of the piezoelectric element decreases with the enhancement of the density of the ink chamber, the resulting lack of deflection restricts the driving conditions for ejection of droplets and hence the range of the weight of droplet to be ejected. Referring to ink viscosity, the deflection of the piezoelectric element with respect to a high viscosity solution is inhibited because the piezoelectric element itself is not supported on a structure. In particular, when the piezoelectric element has a reduced area to meet the requirements for higher density, it is also disadvantageous in that this technique normally can difficultly perform ejection of a solution having a viscosity of 5 mPa·s or more.

On the other hand, in the case where a longitudinal vibration mode piezoelectric element is used, the vibrator takes no part in the response of the ink flow path because the piezoelectric element is mechanically connected to a structure other than the ink pressurizing chamber. Further, in the system comprising a longitudinal vibration mode piezoelectric element, the vibration plate of the ink pressurizing chamber is fixed to another structure with the longitudinal vibration mode piezoelectric element. In this arrangement, the acoustic capacity of the ink pressurizing chamber is so small that the response of the ink flow path to external input from the longitudinal vibration mode piezoelectric element is high. Moreover, since the piezoelectric element is mechanically connected to a structure, the deformation of the piezoelectric element can be efficiently transferred to a high viscosity solution as well. Accordingly, the range of viscosity of solution to which this mode can apply is wide.

SUMMARY OF THE INVENTION

Under these circumstances, an aim of the invention is to provide an ink jet head having a high reliability which allows efficient deformation of vibration plate even if it has a high density and use of a wide variety of inks and a droplet ejection device comprising same.

In order to solve the aforementioned problems, the invention provides an ink jet head comprising a chamber plate having a plurality of pressuring chambers formed therein for storing an ink, a vibrating plate bonded to the chamber plate, a housing having an ink flow path through which an ink is supplied into the pressuring chambers, an orifice through which an ink is ejected from the pressuring chambers and a longitudinal vibration mode piezoelectric element for generating pressure under which an ink droplet is ejected through the orifice, wherein the thickness of the vibration plate is from 5 μm to 10 μm. In this arrangement, the vibration of the longitudinal vibration mode piezoelectric element can be efficiently transferred to the ink chamber.

The ink jet head of the invention is also characterized in that the ratio of the thickness of the vibration plate to the width of the pressurizing chamber is 0.03 or less. In this arrangement, a small ink chamber capable of efficiently ejecting minute droplets can be designed.

The ink jet head of the invention is further characterized in that a solution having a viscosity of from 5 to 25 mPa·s is ejected. In this arrangement, various kinds of solutions can be ejected.

A still other characteristic of the invention is that an ink jet type droplet ejection device comprising the above arranged ink jet head disposed opposed to an ejection substrate and having a mechanism for moving the ink jet head or the ejection substrate is realized.

BRIEF DESCRIPTION OF THE DRAWINGS

The present invention may be more readily described with reference to the accompanying drawings.

DETAILED DESCRIPTION OF THE PREFERRED EMBODIMENTS

An example of the invention will be described in detail hereinafter.

Figure 1:
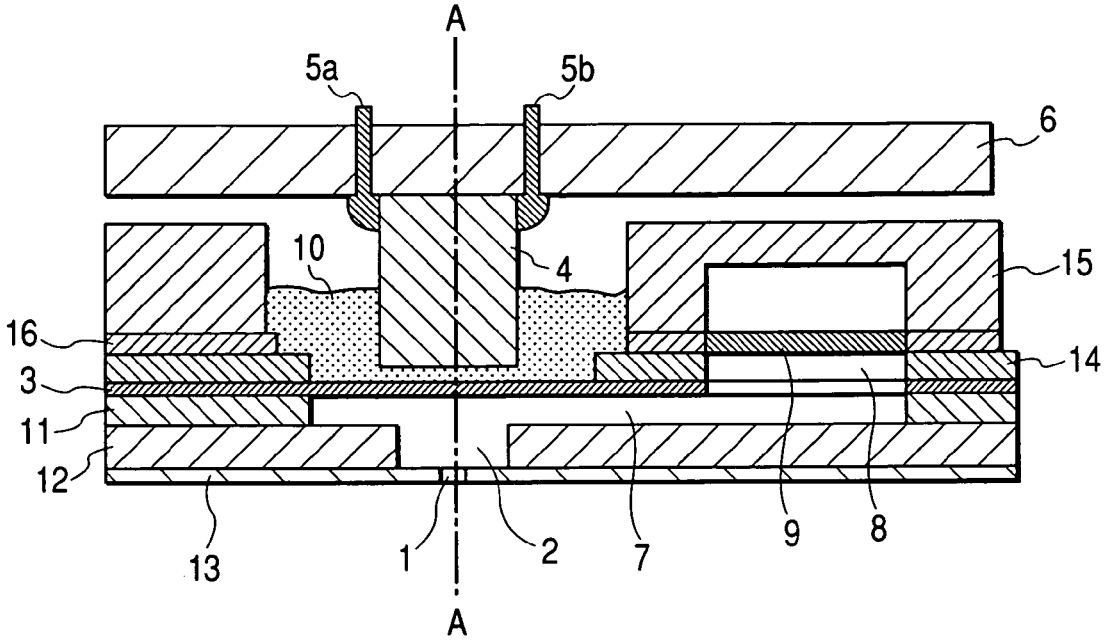
FIG. 1 is a sectional view of an ink jet print head which is an example of the invention.

FIG. 1 is a sectional view illustrating an example of the configuration of the nozzle portion of the ink jet head according to the invention. The reference numeral 1 indicates an orifice, the reference numeral 2 indicates a pressurizing chamber, the reference numeral 3 indicates a vibration plate, the reference numeral 4 indicates a piezoelectric element, the reference numerals 5*a* and 5*b* each indicate a signal input terminal, the reference numeral 6 indicates a piezoelectric element fixing plate, reference numeral 7 indicates a restrictor connecting between a common ink feed channel 8 and the pressurizing chamber 2 for controlling the flow of ink into the pressurizing chamber 2, the reference numeral 9 indicates a filter, the reference numeral 10 indicates an elastic adhesive such as silicon adhesive connecting between the vibration plate 3 and the piezoelectric element 4, the reference numeral 11 indicates a restrictor plate forming the restrictor 7, the reference numeral 12 indicates a pressurizing chamber plate forming the pressurizing chamber 2, the reference numeral 13 indicates an orifice plate forming the orifice 1, the reference numeral 14 indicates a supporting plate reinforcing the vibration plate 3, the reference numeral 15 indicates a housing having the common ink feed channel 8, and the reference numeral 16 indicates a filter plate forming the filter 9.

The vibration plate 3, the restrictor plate 11, the pressurizing chamber plate 12 and the supporting plate 14 each are made of, e.g., stainless steel. The orifice plate 13 is made of nickel or stainless steel. The piezoelectric element fixing plate 6 is made of an insulating material such as ceramics and polyimide. The ink flows downstream through the filter 9 in the common ink feed channel 8, the restrictor 7, the pressurizing chamber 2 and then the orifice 1.

The piezoelectric element 4 expands or contracts when a potential difference is applied across the signal input terminals 5*a* and 5*b* and returns to original state when no potential difference is applied across the signal input terminals 5*a* and 5*b*. The deformation of the piezoelectric element 4 causes the ink in the pressurizing chamber 2 to be pressurized and ejected through the orifice 1.

Figure 2:
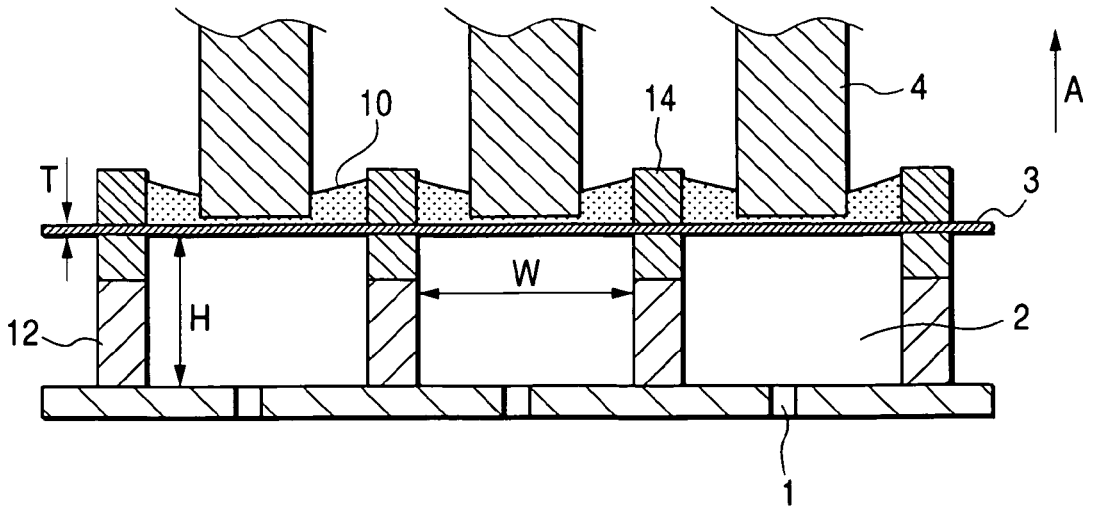
FIG. 2 is a sectional view taken on the line A-A of FIG. 1.

FIG. 2 is a sectional view taken along the line A-A of FIG. 1. As shown in FIG. 2, the ink jet head of the invention comprises pressurizing chambers 2, orifices 1 and piezoelectric elements 4 each disposed at an equal interval. In order to eject the ink, the piezoelectric element 4 contracts and the vibration plate 3 is pulled upward as viewed on the drawing (in the direction indicated by the arrow A). When the vibration plate is deformed using a deflection mode piezoelectric element as represented by bimetal system, the effect on the adjacent ink chambers is little because the individual piezoelectric elements are separated from each other. However, in the case of longitudinal vibration mode involving the direct use of expansion and contraction of piezoelectric element for the deformation of the vibration plate as in the invention, the effect of deforming the ink chamber is great because the individual piezoelectric elements are connected to each other with the piezoelectric element fixing plate 6. In other words, since the individual piezoelectric elements are connected to each other with the piezoelectric element fixing plate 6, vibration is transferred between the piezoelectric elements. Accordingly, the vibration plate which actually vibrates due to the deformation of the deflection mode piezoelectric element extends over the range of W as shown in FIG. 2. However, in the case where the rigidity of the vibration plate is great like the longitudinal vibration mode piezoelectric element, force is applied also to the side wall between the pressurizing chambers 2, causing the entire ink chamber to be pulled relative to the piezoelectric element fixing plate 6 resulting in the deterioration of ejection properties. In particular, when there are many piezoelectric elements which are driven at the same time, the entire line of pressurizing chambers deforms along the line of pressurizing chambers. When the line of pressurizing chambers deforms, vibration generated by the piezoelectric element 4 cannot be efficiently transferred to the pressurizing chamber 2, causing further deterioration of ejection properties.

Figure 3:
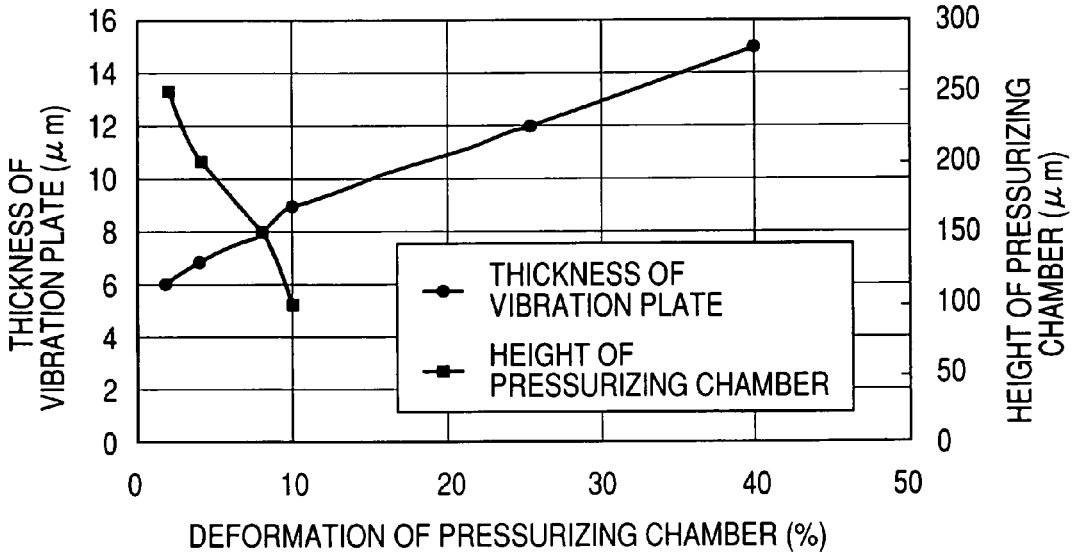
FIG. 3 is a diagram illustrating the relationship between the thickness of the vibration plate and height of the pressurizing chamber and the deformation of the pressurizing chamber.

The deformation of the line of pressurizing chambers depends not only on the thickness T of the vibration plate 3 but also on the height H of the pressurizing chamber 2. FIG. 3 illustrates the results of studies of the effect of the thickness of the vibration plate 3 and the height of the pressurizing chamber 2 on the deformation of the pressurizing chamber 2 when the width of the pressurizing chamber 2 is constant. The deformation of the line of pressurizing chambers can be reduced by changing the height of the pressurizing chamber. However, when the height of the pressurizing chamber is changed, the volume of the pressurizing chamber is changed as well, causing the change of the weight of ink droplet to be ejected. FIG. 3 also shows that the smaller the thickness of the vibration plate 3 is, the smaller is the effect on the deformation of the pressurizing chamber. The thickness T of the vibration plate 3 at which the ejection properties cannot be affected, i.e., the deformation of the pressurizing chamber is 15% or less is preferably 10 μm or less.

In the present experiment, the viscosity of the solution to be ejected was 10 mPa·s. However, when the viscosity of the solution to be ejected was 25 mPa·s at maximum, the relationship between the thickness of the vibration plate and the height of the pressurizing chamber affecting the deformation of the pressurizing chamber remained the same.

The vibration plate 3 is mostly made of a metal or resin. Taking into account corrosion resistance or precision of ink jet head assembly, the vibration plate 3 is preferably made of a metal.

As a representative example, a process for the preparation of a vibration plate made of stainless steel is shown in FIGS. 4*a*-4*d*.

Figure 4A:
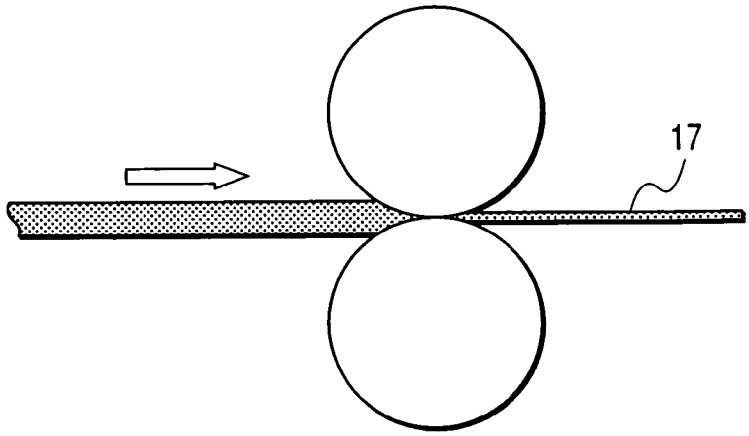
FIGS. 4*a*-4*d* are diagrams illustrating a process for the preparation of a vibration plate for use in the ink jet print head of the invention.

Firstly, as shown in FIG. 4*a*, a thin stainless steel plate 17 having a predetermined thickness is prepared by rolling (step a).

Figure 4B:
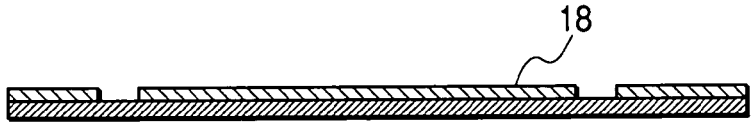

Subsequently, as shown in FIG. 4*b*, in order to make a through-hole at predetermined positions corresponding to ink feed port, etc., a resist 18 is patternwise spread over the plate 17 (step b).

Figure 4C:
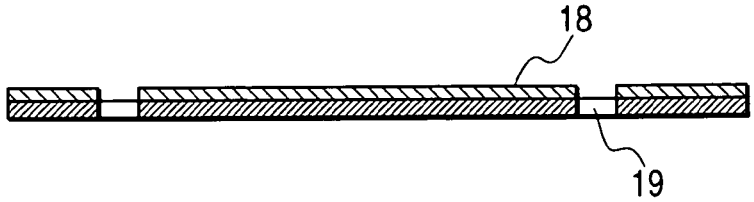

Subsequently, as shown in FIG. 4*c*, the plate 17 is wet-etched with an enchant such as ferric chloride to make a through-hole 19 (step c).

Figure 4D:
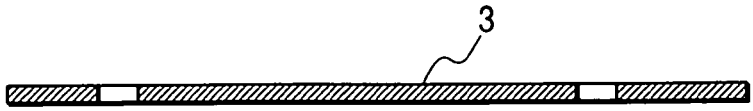

Finally, as shown in FIG. 4*d*, in order to peel the resist 18, clean the plate 17 and enhance the adhesion during bonding to other parts, the entire plate 17 is etched with a nitric acid solution having a concentration of from 1% to 5% for a short period of time (step d).

In this manner, the vibration plate 3 is formed. The thickness of the vibration plate 3 needs to be at least 5 μm because it is likely that minute holes such as pinhole can be generated during etching with nitric acid at the step d.

For the aforementioned reasons of properties and procedure, the thickness of the vibration plate 3 is preferably from 5 μm to 10 μm. While the present example has been described with reference to the case where the vibration plate 3 is made of stainless steel, the material of the vibration plate 3 is not limited so far as it is a metal. Referring to production method, electroforming, press-cutting or laser machining may be employed.

Figure 5:
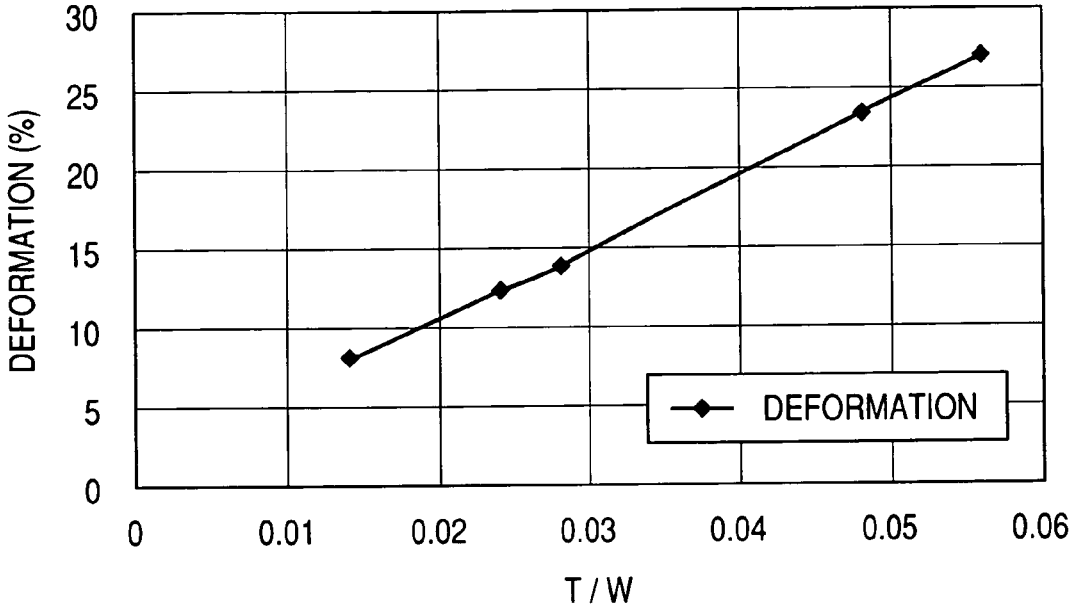
FIG. 5 is a diagram illustrating the deformation of the pressurizing chamber developed when the ratio of the thickness of the vibration plate to the width of the pressurizing chamber changes.

On the other hand, when the width W of the pressurizing chamber 2 changes, the optimum thickness T of the vibration plate 3, too, changes. Thus, the ratio of the thickness T of the vibration plate to the width W of the pressurizing chamber and the deformation of the line of pressurizing chambers were studied. FIG. 5 illustrates the relationship between the ratio of the thickness T of the vibration plate to the width W of the pressurizing chamber and the deformation of the line of pressurizing chambers in the case where the vibration plate is made of stainless steel.

As can be seen in FIG. 5, T/W ratio needs to be 0.03 or less to keep the deformation of the line of pressurizing chambers within a range giving no effect on the ejection properties, i.e., 15% or less. Thus, even when the width of the pressurizing chamber changes, good properties can be maintained by selecting the optimum thickness of the vibration plate.

An example of the droplet ejection device of the invention comprising the aforementioned ink jet head will be described hereinafter.

Figure 6:
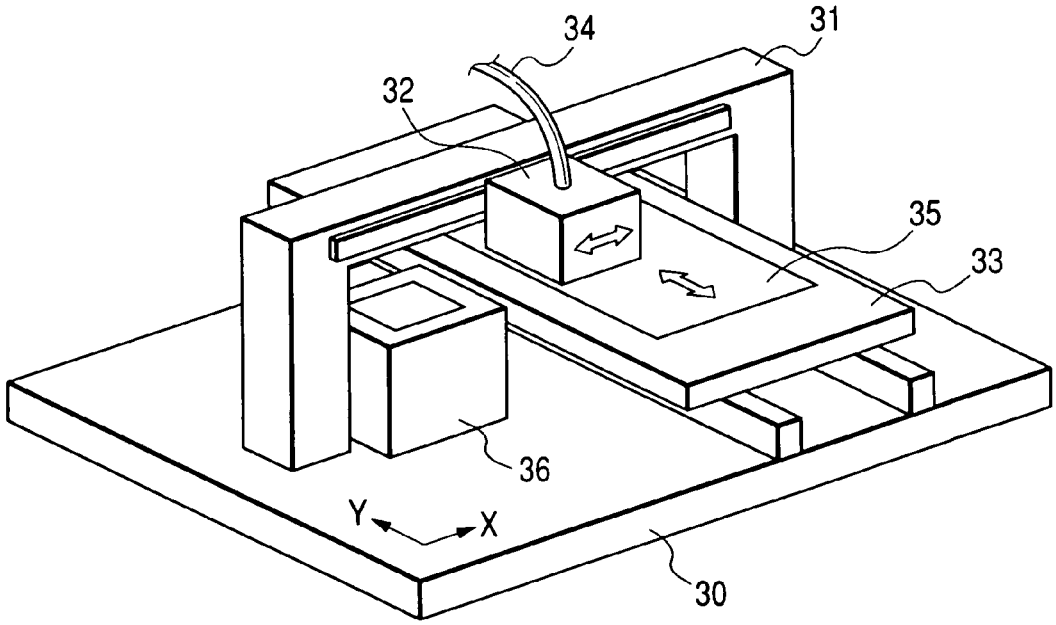
FIG. 6 is a perspective view illustrating the outline of a droplet ejection device having an ink jet head of the invention mounted thereon.

In FIG. 6, a head base 31 is disposed on the top of a housing 30. A head set 32 comprising one or a plurality of print heads mounted thereon is provided on the head base 31. A solution to be ejected is supplied into the head set 32 through an ejection solution feed pipe 34. An ejection substrate base 33 is provided opposed to the orifice 1 of the nozzle of the head set 32 (FIG. 1). A droplet ejection substrate 35 is provided on the ejection substrate base 33. In the present example, the head set 32 is arranged to move in the direction X shown. The droplet ejection device is also arranged such that the ejection substrate base 33 can move in the direction Y. In this arrangement, an arbitrary pattern can be formed on the droplet ejection substrate 35.

While the present example has been described with reference to the case where a cut plate or paper is used as an ejection substrate, no problems arise if a continuous sheet-like substrate is used and a mechanism of conveying the continuous sheet-like substrate is mounted on the droplet ejection device.

As mentioned above, the ink jet head according to the invention comprises a vibration plate having a thickness of from 5 μm to 10 μm, making it possible to efficiently transfer the vibration of the piezoelectric element to the ink chamber. Thus, a high performance ink jet head having a high ejection efficiency can be realized. Further, by forming the vibration plate by a metal and predetermining the ratio of the thickness of the vibration plate to the width of the pressurizing chamber to 0.03 or less, the corrosion resistance of the ink jet head with respect to various kinds of inks can be enhanced. Further, efficient ink ejection can be realized.

What is claimed is:

1. An ink jet head comprising:

a chamber plate comprising a plurality of pressuring chambers formed therein for storing an ink;

a vibrating plate bonded to the chamber plate;

a housing having an ink flow path through which an ink is supplied into the pressuring chambers;

an orifice through which an ink is ejected from the pressuring chambers; and a longitudinal vibration mode piezoelectric element for generating pressure under which an ink droplet is ejected through the orifice, wherein a thickness of the vibrating plate is from 5 μm to 10 μm, and wherein a ratio of the thickness of the vibrating plate to a width of the pressurizing chamber is 0.03 or less.

2. The ink jet head as claimed in claim 1, wherein the vibrating plate comprises a metal.

3. The ink jet head as claimed in claim 1, wherein a solution having a viscosity of from 5 mPa·s to 25 mPa·s is ejected.

4. The ink jet head as claimed in claim 1, wherein a thickness of the vibrating plate is from 7 μm to 10 μm.

5. The ink jet head as claimed in claim 1, further comprising:

a piezoelectric element fixing member for connecting the longitudinal vibration mode piezoelectric elements.

6. An ink jet type droplet ejection device, comprising:

an ink jet head;

an ejection substrate disposed opposed to the ink jet head; and a mechanism for moving one of the ink jet head and the ejection substrate with respect to the other, wherein the ink jet head comprises:

a chamber plate comprising a plurality of pressuring chambers formed therein for storing an ink;

a vibrating plate having a thickness of from 5 μm to 10 μm bonded to the chamber plate;

a housing having an ink flow path through which an ink is supplied into the pressuring chambers;

an orifice through which an ink is ejected from the pressuring chambers; and a longitudinal vibration mode piezoelectrie element for generating pressure under which an ink droplet is ejected through the orifice, wherein a ratio of the thickness of the vibrating plate to a width of the pressurizing chamber is 0.03 or less.

7. The ink jet head type droplet ejection device as claimed in claim 6, further comprising:

a piezoelectric element fixing member for connecting the longitudinal vibration mode piezoelectric elements to each other.

8. The ink jet head type droplet ejection device as claimed in claim 6, wherein a thickness of the vibrating plate is from 7 μm to 10 μm.

9. An ink jet head comprising:

a chamber plate comprising a plurality of pressurizing chambers formed therein for storing an ink;

a vibrating plate bonded to the chamber plate;

a housing having an ink flow path through which an ink is supplied into the pressurizing chambers;

an orifice through which an ink is ejected from the pressurizing chambers;

a longitudinal vibration mode piezoelectric element for generating pressure under which an ink droplet is ejected through the orifice, the longitudinal vibration mode piezoelectric element being connected to a structure other than the chamber plate, wherein a thickness of the vibrating plate is from 5 μm to 10 μm; and signal input terminals disposed on opposing sides of the longitudinal vibration mode piezoelectric element to provide a voltage to the longitudinal vibration mode piezoelectric element.

10. An ink jet head, comprising:

a chamber plate comprising at least one pressurizing chamber formed therein for storing an ink;

a vibrating plate positioned on the chamber plate;

an orifice through which an ink is ejected from the pressurizing chambers; and a piezoelectric element for generating pressure under which an ink droplet is ejected through the orifice, wherein a ratio of the thickness of the vibrating plate to a width of the pressurizing chamber is not greater than 0.03.

11. The ink jet head type droplet ejection device as claimed in claim 10, wherein the vibrating plate comprises a metal.

12. The ink jet head type droplet ejection device as claimed in claim 10, wherein a solution having a viscosity of from 5 mPa·s to 25 mPa·s is ejected.

13. The ink jet bead as claimed in claim 10, further comprising:

an elastic adhesive disposed between the longitudinal vibration mode piezoelectric element and the vibrating plate.

14. The ink jet head as claimed in claim 10, wherein a thickness of the vibrating plate is from 7 μm to 10 μm.

15. The ink jet head as claimed in claim 10, wherein said piezoelectric element comprises a longitudinal vibration mode piezoelectric element.

16. The ink jet head as claimed in claim 15, wherein the longitudinal vibration mode piezoelectric elements are disposed at an equal interval.

17. The ink jet head as claimed in claim 15, further comprising:

a piezoelectric element fixing member for connecting the longitudinal vibration mode piezoelectrie elements to each other.

* * * * *